US006257505B1

(12) United States Patent
Wang

(10) Patent No.: US 6,257,505 B1
(45) Date of Patent: Jul. 10, 2001

(54) SPRINKLING HEAD STRUCTURE OF SPRINKLING GUN

(76) Inventor: King-Yuan Wang, No. 1, Lane 288, Sec. 1, Lu Ho Rd., Lu Kang Chen, Changhua Hsien (TW)

( * ) Notice: Subject to any disclaimer, the term of this patent is extended or adjusted under 35 U.S.C. 154(b) by 0 days.

(21) Appl. No.: 09/734,903

(22) Filed: Dec. 13, 2000

(51) Int. Cl.[7] ..... B05B 7/02

(52) U.S. Cl. ..... 239/526; 239/587.1; 285/184

(58) Field of Search ..... 239/525, 526, 239/532, 340, 289, 436, 437, 587.1, 587.2, 587.5; 285/184, 283, 278, 280, 281

(56) References Cited

U.S. PATENT DOCUMENTS

| | | | | |
|---|---|---|---|---|
| 692,375 | * | 2/1902 | Snider | 239/587.1 |
| 1,125,642 | * | 1/1915 | Blanchard | 239/587.1 |
| 4,266,730 | * | 5/1981 | Grohe | 239/587.1 |
| 4,448,355 | * | 5/1984 | Roman | 239/526 |
| 5,333,792 | * | 8/1994 | Wang | 239/526 |
| 5,566,886 | * | 10/1996 | Wang | 239/526 |

* cited by examiner

*Primary Examiner*—Lisa Ann Douglas
(74) *Attorney, Agent, or Firm*—Dougherty & Troxell

(57) ABSTRACT

Sprinkling head structure of sprinkling gun including a handle in which an inner controlling valve, a discharging key and an inlet connector mounted at a bottom end of the inner controlling valve are disposed. An upper end face of the handle is formed with a rotary face which is forwardly inclined by about 45 degrees. The rotary face is formed with a discharging opening. A lateral half of the periphery of the annular groove is further formed with a shallower slide groove. A lower end face of the sprinkling head is formed with a rotary face which is rearwardly inclined by about 45 degrees. The rotary face of the sprinkling head has a projecting connecting post a periphery of which is cut with several resilient splits at equal intervals for providing the connecting post with a certain resilience. An end section of the connecting post is formed with reverse triangular engaging legs. A restricting key is formed on the rotary face behind the leakproof ring. The connecting post of the sprinkling head is fitted into the discharging opening of the handle with the engaging legs fixedly engaged with the inner periphery thereof. The rotary faces of the sprinkling head and the handle are attached to each other. When the sprinkling head is rotated, the restricting key of the sprinkling head is slid along the slide groove, whereby the sprinkling gun is convertible between a vertical pattern and an L-shaped pattern.

2 Claims, 5 Drawing Sheets

SPRINKLING HEAD STRUCTURE OF SPRINKLING GUN

BACKGROUND OF THE INVENTION

The present invention is related to a sprinkling head structure of sprinkling gun in which the handle and the sprinkling head are formed with cooperative inclined rotary faces, whereby the sprinkling gun is directly conveniently convertible between a vertical pattern and an L-shaped pattern.

FIG. 1 shows a conventional vertical sprinkling gun 10. FIG. 2 shows an L-shaped sprinkling gun 20. Both sprinkling guns include a handle and a sprinkling head which are integrally molded. A discharging key and a rotary sprinkling mouth are respectively mounted on the handle and the sprinkling head. The rotary sprinkling mouth can be rotated to sprinkle water flow with different patterns. However, when sprinkling water, the form of the sprinkling gun cannot be changed in accordance with the sprinkling pattern. Therefore, the sprinkling gun cannot be adapted to different working site. Under some conditions, the vertical sprinkling gun 10 and the L-shaped sprinkling gun 20 must be alternately used. This is inconvenient for a user. Moreover, it is necessary to purchase two kinds of sprinkling guns. This leads to increment of cost.

SUMMARY OF THE INVENTION

It is therefore a primary object of the present invention to provide a sprinkling head structure of sprinkling gun is directly conveniently convertible between a vertical pattern and an L-shaped pattern for different usage and working sites. Therefore, it is no more necessary to purchase two kinds of sprinkling guns so that the cost is saved.

The present invention can be best understood through the following description and accompanying drawings wherein:

DETAILED DESCRIPTION OF THE PREFERRED EMBODIMENT

Figure 2:
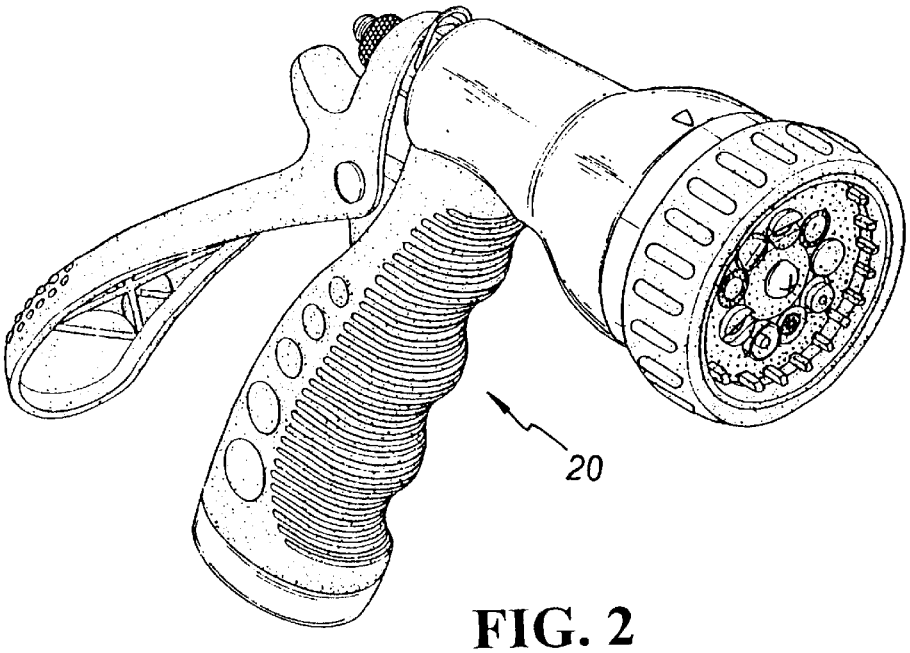
FIG. 2 PRIOR ART
FIG. 2 is a perspective view of a conventional L-shaped sprinkling gun.
Figure 1:
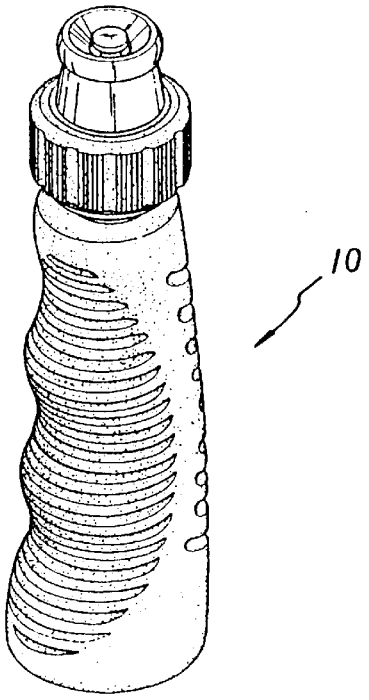
FIG. 1 PRIOR ART
FIG. 1 is a perspective view of a conventional vertical sprinkling gun.
Figure 3:
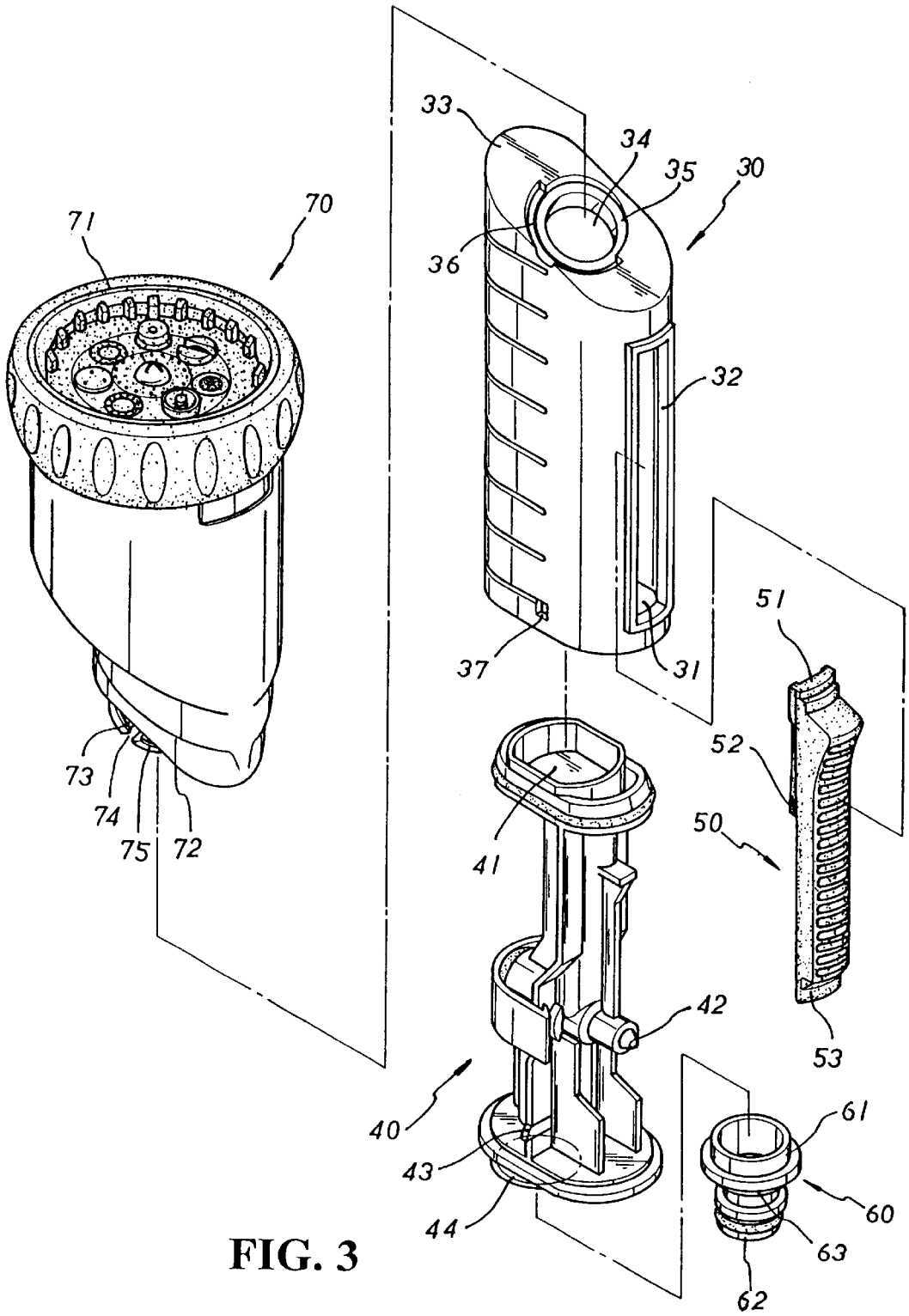
FIG. 3 is a perspective exploded view of the present invention.
Figure 4:
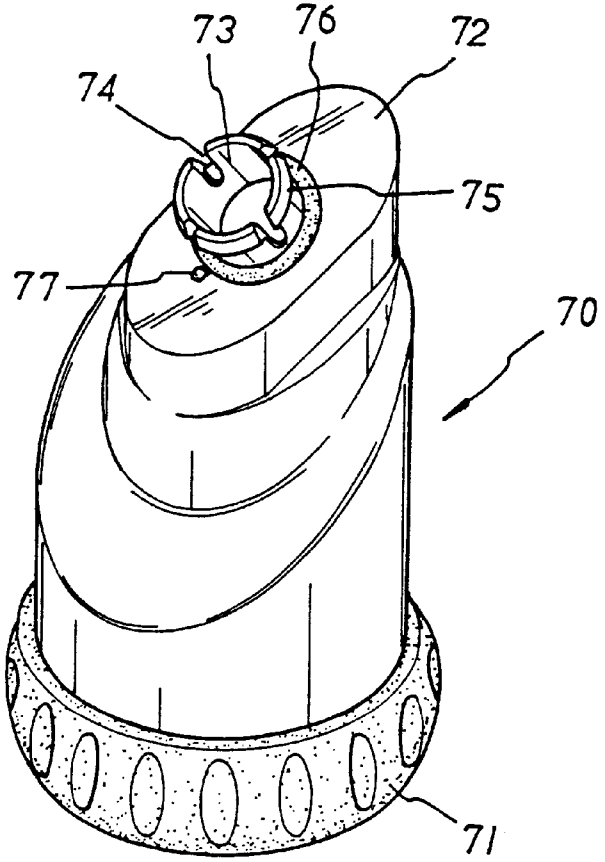
FIG. 4 is a perspective view of the sprinkling head of the present invention seen by another angle.

Please refer to FIGS. 3 and 4. The sprinkling gun of the present invention includes a handle 30, an inner controlling valve 40, a discharging key 50, an inlet connector 60 and a sprinkling bead 70. The handle 30 is formed with an interior chamber 31 having an opening facing downward. A front face of the handle 30 is formed with a slot 32. The upper end face of the handle is a rotary face 33 which is forward inclined by about 45 degrees. The rotary face 33 is formed with a discharging opening 34 communicating with the chamber. The periphery of the discharging opening 34 is formed with a deeper annular groove 35. A lateral half of the periphery of the annular groove 35 is further formed with a shallower slide groove 36 as a rainbow shape. The lower end section of the handle is formed with two engaging holes 37. The inner controlling valve 40 has a shape corresponding to that of the chamber 31 of the handle 30. The valve 40 is formed with a central water passage 41. A front side of the middle portion of the valve has a switch button 42. Two sides of lower section are respectively formed with engaging legs 43. The bottom is formed with an engaging hole 44. The discharging key 50 has a shape corresponding to that of the slot 32 of the handle 30. The front side is downward tapered. The upper end has an outward extending two-step restricting plate 51. Two sides of upper portion are respectively formed with two outward extending restricting blocks 52. The lower end has an outward extending engaging plate 53. The upper portion of the inlet connector 60 is formed with an engaging section 61. The lower portion is a tapered connecting mouth 62 on which a leakproof ring 63 is fitted. The front portion of the sprinkling head 70 is a rotary sprinkling opening 71. The lower end face is formed with a rotary face 72 which is rearward inclined by about 45 degrees (cooperative with the rotary face 33 of the handle 30). The rotary face 72 has a projecting connecting post 73. The periphery of the connecting post 73 is cut with several resilient splits 74 at equal intervals for providing the connecting post 73 with a certain resilience. The end section of the connecting post 73 is formed with reverse triangular engaging legs 75. The reel portion of the connecting post 73 is fitted with a leakproof ring 76. A restricting key 77 is formed on the rotary face 72 behind the leakproof ring 76.

Figure 6:
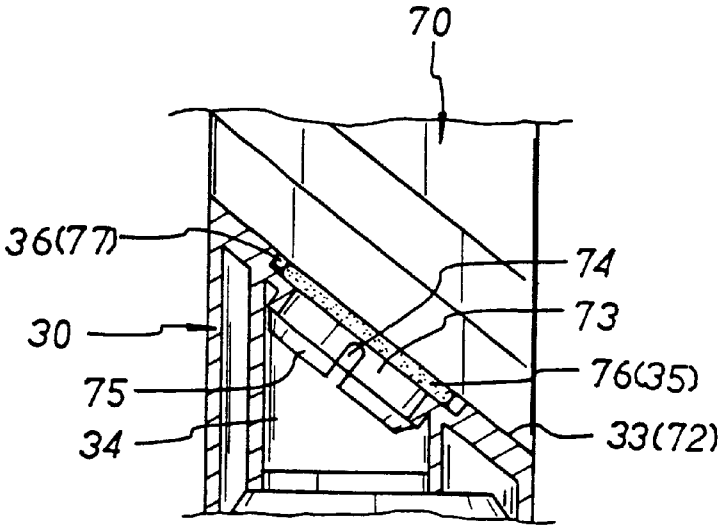
FIG. 6 is a sectional view of the present invention in the vertical state.
Figure 5:
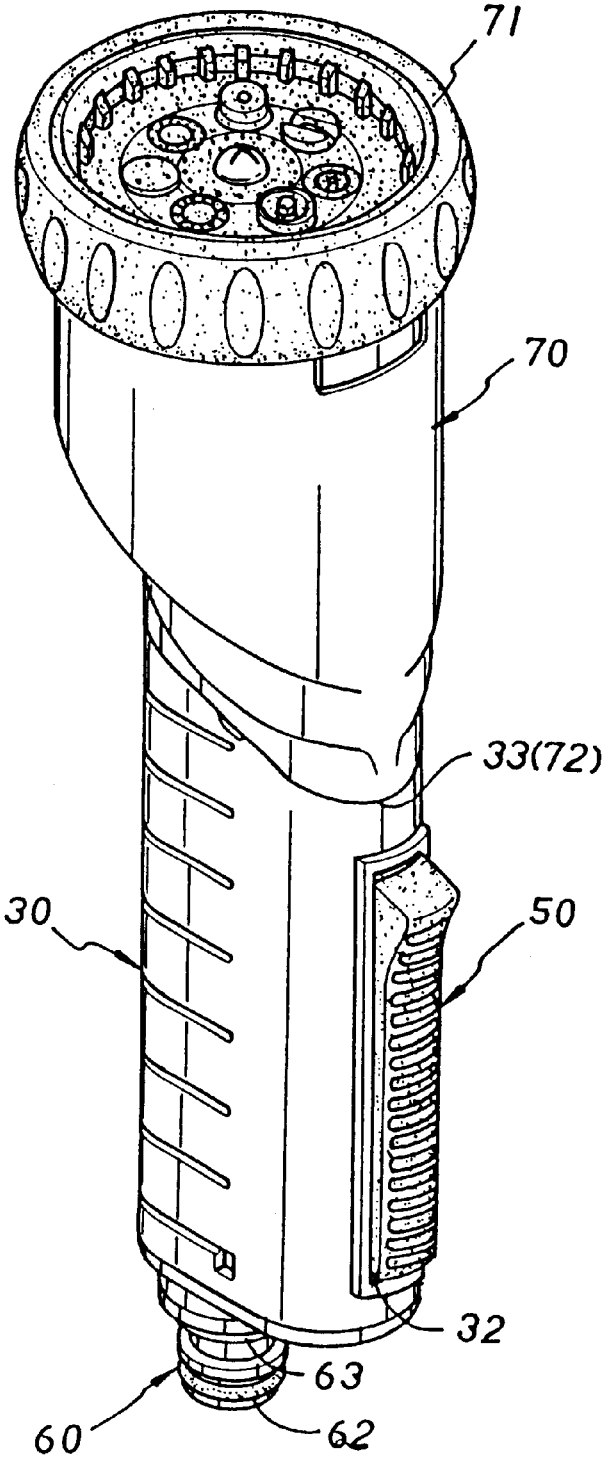
FIG. 5 is a perspective assembled view of the present invention in a vertical state.

When assembled, as shown in FIG. 5, the discharging key 50 is placed into the chamber 31 of the handle 30 and passed through the slot 32 thereof. The restricting plate 51, restricting blocks 52 and the engaging plate 53 are engaged in the slot 32 so as to prevent the discharging key 50 from dropping out. Then the inner controlling valve 40 is placed into the chamber. The switch button 42 is aligned with the discharging key 50 and the engaging legs 43 are fixedly engaged in the engaging holes 37 of the handle 30. The engaging section 61 of the inlet connector 60 is engaged in the engaging hole 44 of the inner controlling valve 40. Finally, the connecting post 73 of the sprinkling head 70 is fitted into the discharging opening 34 of the handle 30 with the engaging legs 75 fixedly engaged with the inner periphery of the discharging opening 34. At this time, the rotary faces 33 and 72 of the sprinkling head 70 and the handle 30 are attached to each other. The obtuse angle of the rotary face 72 of the sprinkling bead 70 is aligned with the acute angle of the rotary face 33 of the handle 30, while the acute angle of the rotary face 72 of the sprinkling head 70 is aligned with the obtuse angle of the rotary face 33 of the handle 30. The leakproof ring 76 fitted around the reel portion of the connecting post 73 is attached to inner wall of the annular groove 35. The restricting key 77 is positioned at an uppermost point of the slide groove 36 (also with reference to FIG. 6). At this time, a vertical type of sprinkling gun is completely assembled. When the sprinkling gun is applied to a farther place and strong water beam is necessary, the sprinkling gun is used in vertical form for, for example, washing a car.

Figure 8:
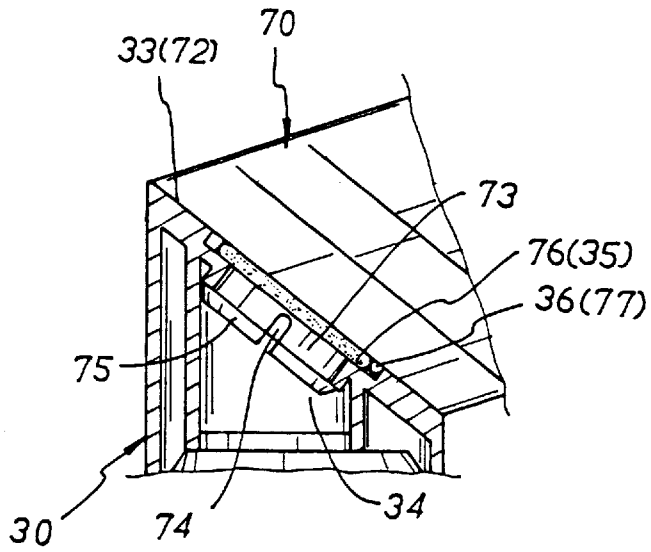
FIG. 8 is a sectional view of the present invention in the L-shaped state.
Figure 7:
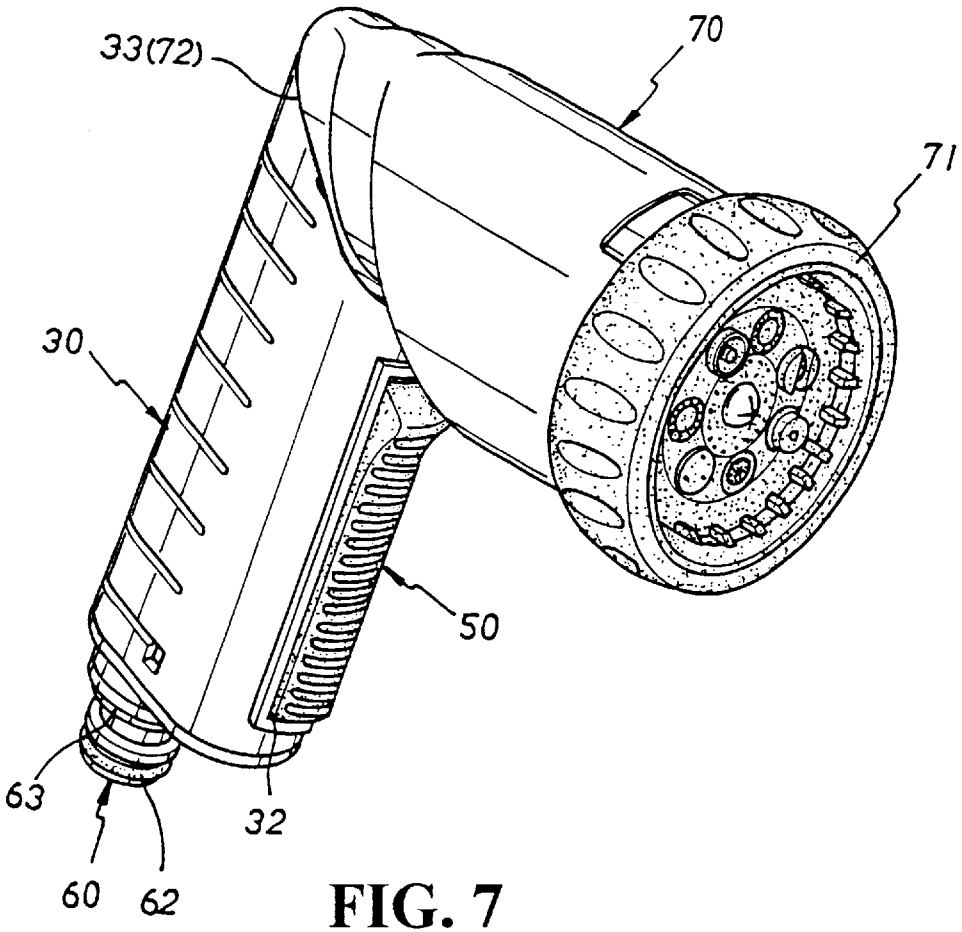
FIG. 7 is a perspective assembled view of the present invention in an L-shaped state.

On the other hand, when the sprinkling gun is used for different usage and weaker radial water beam is discharged, as shown in FIG. 7, the sprinkling gun can be converted into an L-shaped one in such a manner that a user holds the handle 30 with one hand and holds the sprinkling head 70 with the other hand. Then the sprinkling head 70 is rotated by 180 degrees to slide the restricting key 77 of the sprinkling head 70 from the uppermost point of the slide groove 36 along the slide groove 36 to a lowest point thereof. At this time, the obtuse angle of the rotary face 72 of the sprinkling head 70 is aligned with the obtuse angle of the rotary face 33 of the handle 30, while the acute angle of the rotary face 72 of the sprinkling head 70 is aligned with the acute angle of the rotary face 33 of the handle 30 (also with reference to FIG. 8). Therefore, the sprinkling gun is converted into a substantially L-shaped one for use in different working situation.

According to the above arrangement, the sprinkling gun of the present invention can be directly converted between a vertical pattern and an L-shaped pattern for different usage and working sites. Therefore, it is no more necessary to purchase two kinds of sprinkling guns so that the cost is saved. In addition, the sprinkling head 70 can be directly rotated to change the pattern without extracting the sprinkling head. Therefore, a user can more conveniently use the sprinkling gun.

The above embodiment is only used to illustrate the present invention, not intended to limit the scope thereof. Many modifications of the above embodiment can be made without departing from the spirit of the present invention.

What is claimed is:

1. Sprinkling head structure of sprinkling gun comprising a handle, an inner controlling valve, a discharging key, an inlet connector and a sprinkling head, the handle being formed with an interior chamber having an opening facing downward, the inner controlling valve and the discharging key being received in the chamber, the inlet connector being connected with a lower end of the inner controlling valve, a front portion of the sprinkling head being formed with a rotary sprinkling opening, said sprinkling head structure being characterized in that:

an upper end face of the handle is formed with a rotary face which is forwardly inclined by a certain angle, the rotary face being formed with a discharging opening, a periphery of the discharging opening being formed with a deeper annular groove, a lateral half of the periphery of the annular groove being further formed with a shallower slide groove, a lower end face of the sprinkling head being formed with a rotary face which is rearwardly inclined by a certain angle which is cooperative with the inclination angle of the rotary face of the handle, the rotary face of the sprinkling head having a projecting connecting post, a periphery of the connecting post being cut with several resilient splits at equal intervals for providing the connecting post with a certain resilience, an end section of the connecting post being formed with reverse triangular engaging legs, a reel portion of the connecting post being fitted with a leakproof ring, a restricting key being formed on the rotary face behind the leakproof ring; and when assembled, the connecting post of the sprinkling head is fitted into the discharging opening of the handle with the engaging legs fixedly engaged with the inner periphery of the discharging opening, the rotary faces of the sprinkling head and the handle being attached to each other, the leakproof ring fitted around the reel portion of the connecting post being tightly attached to an inner wall of the annular groove, the restricting key being positioned in the slide groove, when the sprinkling head is rotated, the restricting key of the sprinkling head being slid along the slide groove with the rotary face of the sprinkling head kept attached to the rotary face of the handle, whereby the sprinkling gun is directly convertible between a vertical pattern and an L-shaped pattern for different usage and working sites.

2. Sprinkling head structure of sprinkling gun as claimed in claim 1, wherein the rotary face of the upper end face of the handle is inclined by an angle cooperative with the inclination angle of the rotary face of the sprinkling head.

* * * * *